US006039702A

United States Patent [19]

Cutler et al.

[11] Patent Number: 6,039,702

[45] Date of Patent: Mar. 21, 2000

[54] MICROCONTROLLER BASED MASSAGE SYSTEM

[75] Inventors: Stanley Cutler, Van Nuys; Gayle B. Gerth, Dana Point, both of Calif.; Alton B. Otis, Jr., Port Townsend, Wash.; Taylor Chau, Cerritos, Calif.

[73] Assignee: JB Research, Inc., Bellflower, Calif.

[21] Appl. No.: 08/901,374

[22] Filed: Jul. 28, 1997

Related U.S. Application Data

[60] Provisional application No. 60/022,977, Aug. 2, 1996.

[51] Int. Cl.[7] ..... A61H 1/00; A61H 23/02

[52] U.S. Cl. ..... 601/15; 601/57

[58] Field of Search ..... 601/46, 47, 48, 601/49, 56, 57, 58, 59, 60, 70

[56] References Cited

U.S. PATENT DOCUMENTS

| | | | |
|---|---|---|---|
| 2,924,216 | 2/1960 | Stewart . | |
| 4,157,088 | 6/1979 | Gracey . | |
| 4,779,615 | 10/1988 | Frazier . | |
| 5,020,517 | 6/1991 | Foster, Jr. et al. | 128/33 |
| 5,188,096 | 2/1993 | Yoo . | |

FOREIGN PATENT DOCUMENTS

| | | |
|---|---|---|
| 3537210 | 4/1986 | Germany . |
| 9715264 | 5/1997 | WIPO . |

*Primary Examiner*—Danton D. DeMille

*Attorney, Agent, or Firm*—Sheldon & Mak

[57] ABSTRACT

A computer controlled massaging system includes a pad; a plurality of motorized vibrators in respective regions of the pad; a heater element in the pad; a microprocessor controller; an array of input elements responsive to operator input for signaling an intensity control value, at least one region signal relating motors to be activated, and a heat control input; and a plurality of motor drivers and a heater driver responsive to the controller. The motors can be variably driven using pulse-width modulation, with duty cycle compensation for voltage drops resulting from added loads, and with current limiting when, for example, the system is powered from an AC line using a low-voltage transformer of limited capacity. Also disclosed is a corresponding method for massaging. The system can have a power detector for identifying sources of power having greater and lesser voltage drops as loads are added, the controller being programmed for increasing a base duty cycle and reducing a load increment duty cycle during operation from the power source of lesser voltage drop. A configuration selector can signal particular components being electrically connected in the system for utilizing a single set of programmed instructions in the program memory in variously configured examples of the massaging system. The system can also include an audio detector having an audio mode input element for selectively activating the motors in response to a detected envelope of an external audio signal. The system can also include a test mode that automatically sequentially activates components of the system.

21 Claims, 9 Drawing Sheets

MICROCONTROLLER BASED MASSAGE SYSTEM

RELATED APPLICATION

This application claims the benefit of U.S. Provisional Application Ser. No. 60/022,977, filed Aug. 2, 1996 now abandoned.

REFERENCE TO APPENDIX

Attached hereto and incorporated herein is Appendix A, which is the hard copy printout of the assembly listing of the source code for the "Samsung Assembly Language" computer programs, which program (configure) the processors and computers disclosed herein to implement the methods and procedures described herein. Appendix A consists of 45 pages. This assembly listing is subject to copyright protection. The copyright owner has no objection to the facsimile reproduction of the patent disclosure, as it appears in the Patent and Trademark Office patent files or records, but otherwise reserves all copyright rights whatsoever.

BACKGROUND

The present invention relates to a massaging apparatus, and more particularly to an improved microcontroller based controller for such apparatus. Conventional massaging apparatus is essentially manually operated. Although electronic sources produce varying types of vibrations variously applied to the user's body, these are limited, essentially because they are, at least, modestly integrated. For example, a source of audio from a tape may form the programming source. In general, more sophistication in the massaging and heating of the body is desired, not only as a sales tactic but also and, perhaps more importantly, as an adjunct to medical treatment.

SUMMARY

The present invention provides a microcontroller based massage system utilizing small DC motors with eccentric mass elements as the vibratory source. The motors are embedded in a pad upon which the user lies or reclines. The pad may also contain embedded heaters to enhance the massage. The system is activated via a remote control device containing key switches or push buttons and visual status indicators. The wand connects to the massage pad via a cable. The wand and massage pad are powered from either a wall transformer or a battery, the latter affording portable operation. In its fullest implementation, the massage pad is body length and contains a plurality of motors and heaters. Typically, the heaters are located in the center of the shoulder and lower back areas and the motors are located in 5 zones distributed over the body length. Several advantages are derived from this arrangement. Computerizing the various modes and operations facilitates the use of the massaging and heating apparatus. Thus, the user can experience a wider variety of massage. A larger variety of options of vibrating sources and how they inter-operate is made available. Total operational variety is simpler to obtain through computer programming than manually.

In one aspect of the invention, the system can be powered from a first source having a voltage drop as loads are applied, wherein each motor power signal has a maximum duty cycle being a base duty cycle plus a load increment duty cycle for each of the motors being simultaneously activated, the microprocessor controller periodically activating the drivers for producing, in response to the intensity control value, respective operating duty cycles for the activated motors being limited to the maximum duty cycle. The system can further include a heater element in the pad, a heater driver responsive to the microprocessor controller for activating the heater element, wherein the signaling further includes a heat control input, and wherein the maximum duty cycle of each motor power signal is preferably augmented by a heater increment duty cycle when the heater element is activated for compensating voltage drops. Preferably the system has a duty cycle upper limit that is a base limit less a portion of the load increment for each of the motors being simultaneously activated and, if the heater element is activated, the upper limit being further reduced by a heater reduction duty cycle, the maximum duty cycle of each motor power signal being limited to not more than the duty cycle upper limit for limiting a maximum power from the first source. Each motor power signal can have a minimum duty cycle, the operational duty cycle being scaled from the product of the intensity control value and the maximum duty cycle less the minimum duty cycle, the minimum duty cycle being added to the product.

The heat control input can have off, high, and low states for selectively powering the heater at high power, low power, and no power, the microprocessor controller being operative for activating the heater driver to power the heater element at high power when the heat control input is high, at no power when the heat control input is off, and at low power when the heat control input is low, except preferably that when the heat control input is changed from off to low, the microprocessor controller is operative for powering the heater at high power for a warm up interval of time prior to the low power, the warm up interval being dependent on a time interval of the off state of the control input.

The system can be used additionally with a second power source not having a voltage drop as great as the voltage drop of the first source as loads are added, the system preferably including a power detector for sensing whether the second power source is being used, the microprocessor being programmed for increasing the base duty cycle and reducing the load increment duty cycle during operation from the second power source.

Preferably the system further includes a configuration selector for determining and signaling to the microprocessor controller particular components being electrically connected in the system for utilizing a single set of programmed instructions in the program memory in variously configured examples of the massaging system.

In another aspect of the invention, the system includes the pad, the plurality of vibratory transducers, the microprocessor controller, the array of input elements, the plurality of motor drivers, and the configuration selector. The input elements can be connected in a matrix for scanning by the microprocessor controller, the configuration selector including a plurality of diodes connected between respective portions of the matrix and the microprocessor controller.

In another aspect of the invention, the system includes the pad, at least one vibratory transducer, the heater element in the pad, the motor driver, the heater driver, the array of input elements, with the heat control input having off, high, and low states corresponding to high power, low power, and no power of the heater element, and the microprocessor controller being operative for activating the heater driver to power the heater at high power when the heat control input is high, at no power when the heat control input is off, and at low power when the heat control input is low, except that when the heat control input is changed from off to low, the microprocessor controller is operative for powering the heater at high power for a warm up interval of time prior to the low power, the period of time being dependent on a time interval of the off state of the control input.

In a further aspect of the invention, the massaging system includes the pad, the plurality of transducers, the heater element, the microprocessor controller, the array of input elements, with the signaling including at least one mode signal and the heat control input, the plurality of motor drivers, and the heater driver, the microprocessor controller being operative in response to the input elements for activating the motors and the heater element for operation thereof in correspondence with the input elements, and in a test mode wherein each of the motors and the heater is activated sequentially in accordance with substantially every state of the region signal, mode signal, and the heat control input, the motors being activated at power levels responsive to intensity control value. The signaling can further include a speed input for determining a rate of sequencing mode component intervals, and wherein, during the test mode, the sequential activation is at a rate proportional to the speed input.

In yet another aspect of the invention, the massaging system includes the pad and vibratory transducer, the array of input elements with the signaling including an audio mode signal, and an audio detector for detecting an audio envelope, the microprocessor controller being operative for generating the motor power signal in response to the audio envelope.

The invention also provides a method for massaging a user contacting a pad, using electrical power from a source having a voltage drop as loads are added, includes the steps of:

(a) providing a plurality of eccentric motor vibrators in respective regions of the pad;

(b) providing a microprocessor controller, an array of input elements for interrogation by the controller, and a plurality of drivers for powering the vibrators from the power source in response to the controller;

(c) interrogating the input elements by the controller to determine an intensity control value and vibrators to be activated;

(d) determining a maximum duty cycle being a base duty cycle plus a load increment duty cycle for each of the vibrators to be activated; and (e) periodically activating the drivers for producing respective operating duty cycles of activated motors being responsive to the intensity control value and limited to the maximum duty cycle.

The method can include the further steps of:

(a) providing a heater element in the pad;

(b) providing a heater driver for powering the heater element in response to the controller;

(c) the interrogating step includes determining a heat control input; and (d) the step of determining the maximum duty cycle comprising adding a heater increment duty cycle when the heater element is activated; determining a duty cycle upper limit being a base limit less a portion of the load increment for each of the motors being simultaneously activated and, if the heater element is activated, the upper limit being further reduced by a heater reduction duty cycle; and limiting the maximum duty cycle of each motor power signal to not more than the duty cycle upper limit.

DRAWINGS

These and other features, aspects, and advantages of the present invention will become better understood with reference to the following description, appended claims, and accompanying drawings, where:

Figure 1:
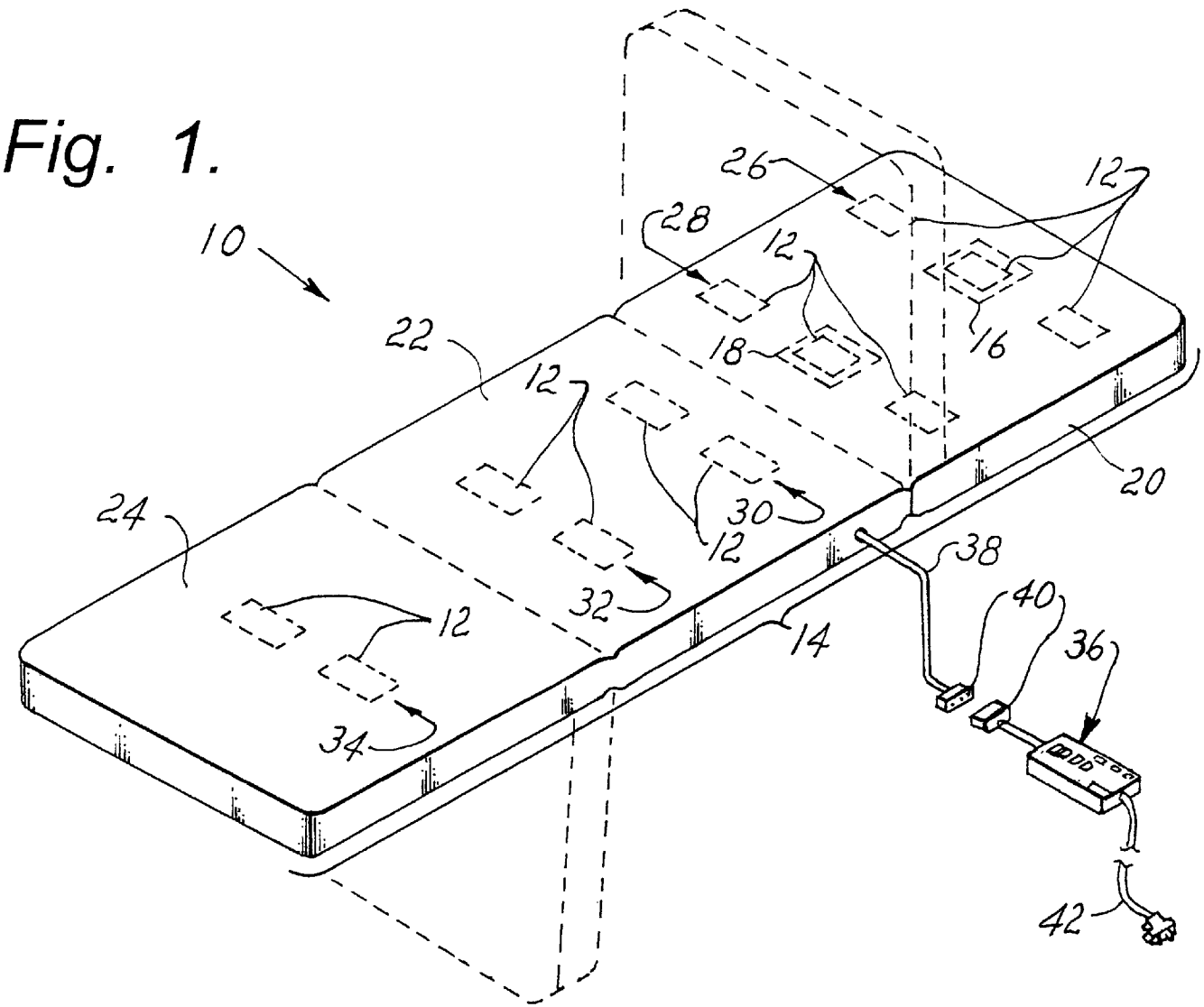
FIG. 1 is a perspective view of a massaging system according to the present invention.
Figure 2:
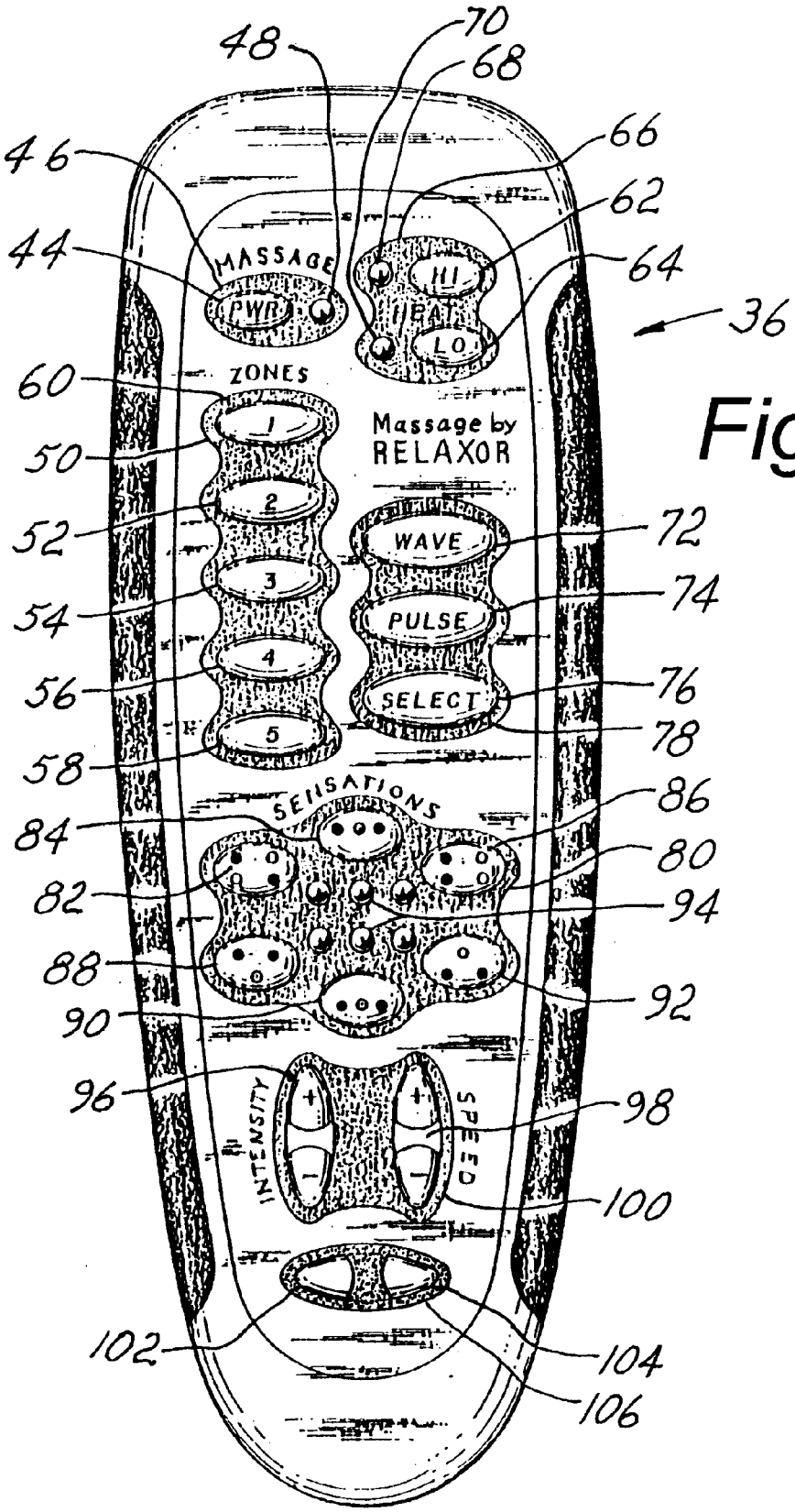
FIG. 2 is an enlarged view of a controller portion of the system of FIG. 1.
Figure 4A:
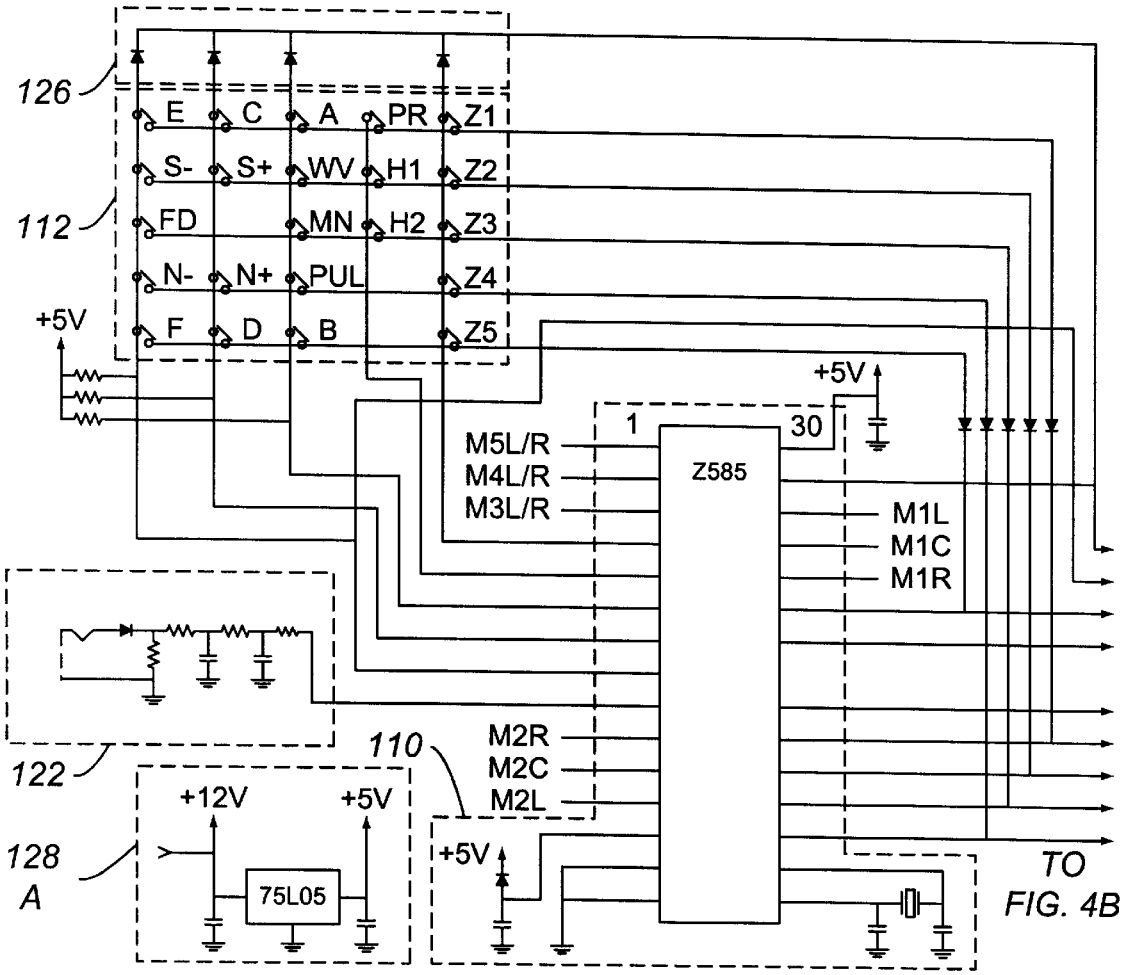
Figure 4A:
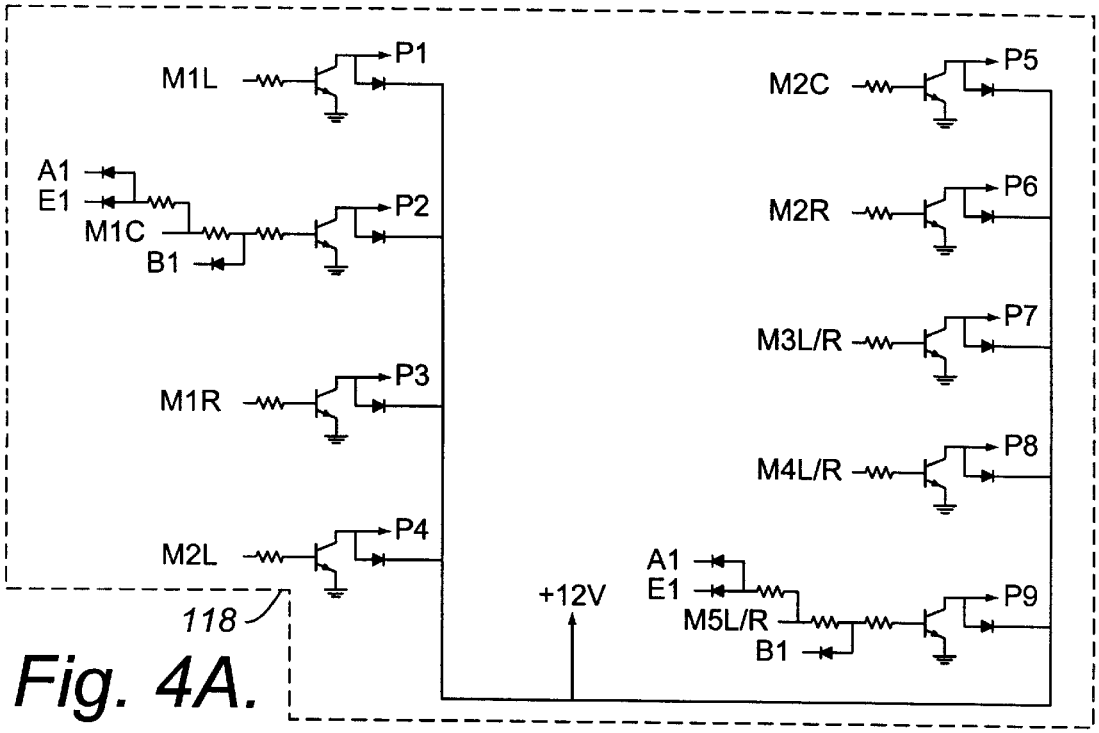
Figure 4B:
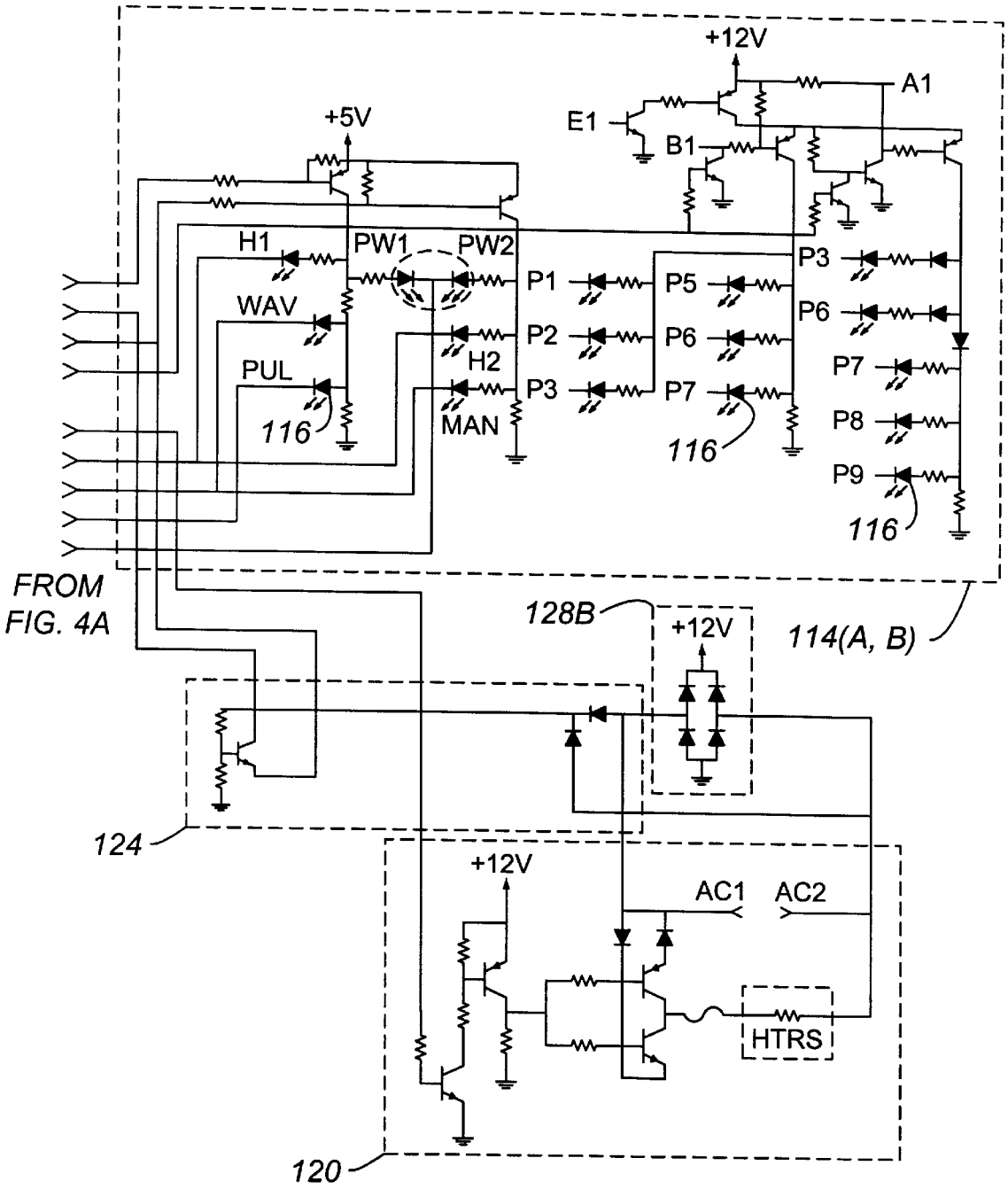

FIG. 4 (presented on separate sheets as FIGS. 4A and 4B) is a circuit diagram detailing the controller portion of FIG. 2; and FIGS. 5–12 are flow charts of a microprocessor program of the system of FIG. 1.

DESCRIPTION

Accordingly, as illustrated in FIGS. 1 and 2, the present invention comprises a microcontroller based massage system 10 utilizing a plurality of vibrators 12 that are embedded in a massage pad 14 upon which a user lies or reclines. Each vibrator 12 is of conventional construction, and may comprise a small DC motor that rotates an eccentric weight, or if desired, a pair of eccentrics at opposite ends of the motor, the vibrators 12 being sometimes referred to herein as motors. Thus the vibrator 12 is caused to vibrate as the eccentric weight rotates. It will be understood that other forms of vibrators may be used. The pad 14 may also contain embedded heaters 16 and 18 for enhanced massaging. The pad 14 may be divided into foldable sections such as an upper section 20 (upper and lower back), a middle section 22 (hips and thighs), and a lower section 24 (calves).

In the exemplary configuration shown in FIG. 1, the pad 14 is body length, having twelve vibrators 12 arranged in groups of two and three motors in five zones, as follows: (1) a first zone 26 for the left side, center, and right side of the shoulder area; a second zone 28 for the left side, center, and right side of the lower back; a third zone 30 for the left and right hips; a fourth zone 32 for the left and right thighs; and a fifth zone 34 for the left and right calves. Typically, the heaters 16 and 18 are centrally located in the shoulder and lower ack areas 26 and 28. It will be understood that other groupings and numbers of zones are contemplated.

The system 10 is activated via a remote control device or wand 36 containing push buttons or keys and visual status indicators, as more fully described below. The wand 36 is removably coupled to the massage pad via a cable 38, such as by a plug and socket coupling 40. The wand 36 and the massage pad 14 are powered from either a wall transformer through an electric cord 42 or a battery, the latter affording portable operation. The control wand 36 provides a variety of functions or modes which are performed through the manipulation of buttons, keys or equivalent means, with corresponding light to designate the selected function.

In some modes of operation, several of the buttons act as double or triple action keys, as further described herein. Specifically, as depicted in FIG. 2, power is turned on or off by a "PWR" button 44 centered within an area 46 designed "MASSAGE" and, when power is supplied, a light-emitting diode (LED) 48 is illuminated. The PWR or power button 44 also acts as a triple action key for selecting massage duration and test modes, described below. The five zones 26–34 are individually actuable by pressing corresponding buttons 50, 52, 54, 56 and 58 within a "ZONES" area 60. Visual status indications can be obtained by respective light being disposed below or adjacent corresponding buttons or keys. The heaters 16 and 18 are operable at two levels, for example by respective "HI" and "LO" heat buttons 62 and 64, within "HEAT" area 66, with corresponding status indications by illumination of respective LEDs 68 and 70 that are adjacent the buttons 62 and 64. The buttons 62 and 64 are also sometimes referred to as upper and lower heater buttons, because they can also act as triple action keys, sequentially selecting heat levels separately for the heaters 16 and 18 as described below.

The WAVE, PULSE AND SELECT operational modes are provided by pressing respective buttons 72, 74 and 76, all enclosed within a modes area 78, SELECT being synonymous with manual operation. Special effects are obtained through manipulation of buttons 82, 84, 86, 88, 90 and 92, in a "SENSATIONS" area 80, respective LEDs 94 being positioned respectively to represent the six vibrators 12 in the first and second zones 26 and 28. Similarly, "INTENSITY" and "SPEED" adjustments are provided by the pressing of respective toggle switch buttons 96 and 98 within a common area 100. The operations or effects of the various buttons of the wand 36 are described below.

Operation Modes

Operation is effected in several modes, viz., manual, wave, pulse, and special effects. In the manual mode, effected by pressing SELECT button 76, the vibrators 12 in enabled massage zones 26–34 run continuously. The user may enable and disable the zones and adjust the massage intensity. In the wave mode (WAVE button 72), the enabled massage zones 26–334 are cycled sequentially from first (26) to fifth (34) and back to first, and so forth. The user may enable and disable zones, adjust the massage intensity and adjust the cycling speed. In the pulse mode (PULSE button 74), the enabled massage zones are simultaneously pulsed on and off. The user may enable and disable zones, adjust the massage intensity, adjust the pulsing speed and set the pulse on/off ratio, for example, to 50/50. Other ratios may be selected by design, with more than one ratio being effected by multiple presses of the pulse key 74.

In the special effects mode (buttons 82–92), preset combinations of the six motors in the first and second zones 26 and 28 are selected for alternate action as follows, where the open and closed circles on keys 82–92 indicate how the zones alternate:

For key 82, zone 1 left and zone 2 right alternating with zone 1 right and zone 2 left;

For key 84, zone 1 left and right alternating with zone 1 center;

For key 86, zones 1 and 2 left alternating with zones 1 and 2 right;

For key 92, zone 2 left and right alternating with zone 1 center;

For key 90, zone 2 left and right alternating with zone 2 center; and For key 88, zone 1 left and right alternating with zone 2 center.

The user may adjust the massage intensity and the alternating speed, and may also select audio intension control for each mode.

Function Keys

The function keys are in three major groups, namely selector, control, and mode. The selector keys include the power button 44, the upper and lower heater buttons 62 and 64, and the five zone buttons 50–58. More specifically, the selector keys are used to turn on and off the massage and heater functions and select which massage zones are active. These are multiple action keys that cycle to the next of two or three operating states on successive pressings.

The control keys include the up/down intensity buttons 90 (labeled "+" and "−"), the up/down speed buttons 98 (labeled "+" and "−"), and the fade and audio buttons 102 and 104. These keys are used to control the massage intensity and the operating mode speeds.

The mode keys include the SELECT or manual button 76, the wave button 72, the pulse button 74, and the six special effects buttons 82–92. The mode keys are used to select the current massage operating mode.

Regarding the specific selector keys, the power button 44 is a triple action key that cycles massage power through the states of "off", "on for 15 minutes" and "on for 30 minutes". The LED 48 is preferably bi-color for facilitating indication of the current massage power state. When an "on" state is selected, the massage system 10 will automatically turn off after operating for the selected time period.

The heat button 62 acts as a triple action key for cycling the upper heater 16 through the states of "off", "on low" and "on high". The LED 68 indicates the "on" states by periodically flashing off in the low state and staying on steady in the high state. When an "on" state is selected, the heater 16 will automatically turn off after 30 minutes. When the unit is configured for a single heater, the button 62 becomes the "high heat" key. In this mode it has a dual action selecting between the "off" and "on high" states and interacting mutually exclusively with the "low heat" key described below. The heater and massage power keys operate independently of each other. The lower heater 18 is operated similarly as heater 16, using the other heat button 64. When the unit is configured for a single heater, this button 64 becomes the "low heat" key. In this mode, the button 64 has a dual action selecting between the "off" and "on low" states and interacting mutually exclusively with the "high heat" key (button 62) described above.

The five buttons 50–58 act as dual action keys for enabling and disabling operation of the left and right vibrators 12 in the respective massage zones 26–34. Visual indicators associated with each key can be activated when the corresponding zone is enabled. The massage action produced by the enabled motors is determined by the currently selected operating mode.

Regarding the control keys, the intensity buttons 96 are a pair of individually operated or toggled keys that increase and decrease, respectively, the intensity of the massage. Briefly pressing and releasing either key will change the intensity setting to the next step. Pressing and holding either key will continuously change the setting until the key is released or the upper or lower limit is reached. Since the intensity of the massage provides feedback to the user, there are no visual indicators associated with these keys.

The speed buttons 98 are a pair of individually operated or toggled keys increase and decrease, respectively, the speed at which certain of the operating modes change the massage action. Briefly pressing and releasing either key will change the speed setting to the next step. Pressing and holding either key will continuously change the setting until the key is released or the upper or lower limit is reached. Since the speed at which the massage action changes provides feedback to the user, there are no visual indicators associated with these keys.

The fade button 102 is a dual action key that enables or disables the fade in/out function. When disabled, changes in the motor state (on-to-off or off-to-on) are abrupt. When enabled, the change occurs gradually over a short period of time, overlapping the stopping action of the vibrators 12 currently active in a particular zone with the starting action of the vibrators 12 in next zone to be activated, thus producing a smooth transition. Since the way in which the vibrations provides feedback to the user, there is no visual indicator associated with this key.

The audio button 104 is a dual action key that enables or disables intensity control from an external audio source. When disabled, motor intensity is controlled exclusively by the intensity keys 96. When enabled, motor intensity is controlled by an amplitude envelope of the signal from the audio source, up to a maximum level as set by intensity key 96. Since the way in which the motor intensity changes provides feedback to the user, there is no visual indicator associated with this key.

Regarding the mode keys, when the select or manual mode button 76 is operated, the associated visual indicator is activated, and the zone buttons 50–58, the intensity buttons 96, and the audio button 104 are operative for customizing the massage action. Pressing manual button 76 terminates any previous operating mode.

When the wave mode button 72 is operated, the associated visual indicator is activated, and the speed and fade buttons 98 and 102 aor operative, in addition to the zone buttons 50–58, the intensity buttons 96, and the audio button 104, for customizing the massage action. Pressing wave button 72 also terminates any previous operating mode.

When the pulse mode button 74 is first operated, the on/off duty cycle is set to 50/50. Pressing the pulse key again changes the duty cycle to 20/80 to provide a "tapping" sensation. Repeated pressings alternate between the 50/50 and 20/80 settings. The associated visual indicator is activated in the pulse mode. The zone, intensity, speed, fade and audio keys (buttons 50–58, 96, 98, 102 and 104) may be used to customize the massage action. Pressing the pulse key 74 terminates any previous operating mode.

When any of the six special effects buttons 82–92 are operated for selecting a corresponding special effect mode, the intensity, speed, fade and audio buttons 96, 98, 102 and 104 may each be used to customize the massage action. The special effects buttons are mutually exclusive, allowing only one special effect mode at a time, any previously selected zone or mode also being disabled until one of the manual, wave or pulse keys is pressed. Visual indication of activation of each vibrator 12 in the first and second zones 26 and 28 is provided by corresponding one of the LEDs 94. The visual indicators associated with the zone keys are disabled during the special effects modes.

Pressing the manual, wave or pulse key while in a special effect mode starts the new mode with the last combination of selected zones re-enabled. Pressing a zone key while in a special effect mode automatically enables the selected zone in manual mode. Any other previously enabled zones are disabled.

System Architecture

Figure 3:
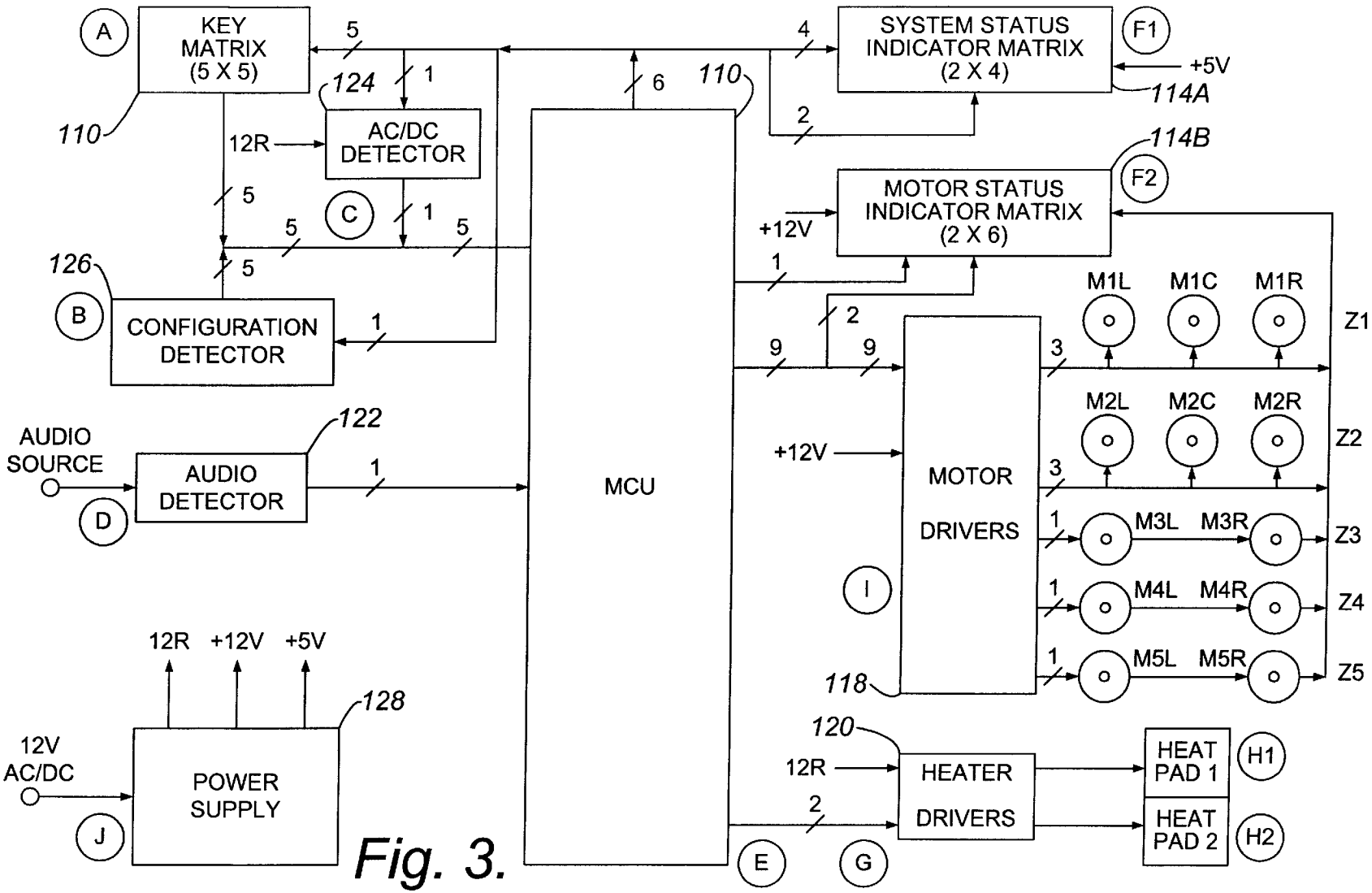
FIG. 3 is a block diagram of the system of FIG. 1.

Referring to FIGS. 3 and 4, the control architecture of the massage system 10 is based on a microcontroller (MCU) 110 in the wand 36, e.g., a 4-bit KS57P0002-01 chip manufactured by Samsung Electronics. The functional blocks shown in FIG. 3 and the corresponding circuit diagram of FIG. 4 include a KEY MATRIX 112, its 23 keys being electronically wired in a 5-by-5 matrix that is periodically scanned by the MCU chip 110. The scanning algorithm uses leading edge detection with trailing edge filtering or debouncing. This provides rapid response to key pressings and eliminates multiple pressing detection due to slow contact closure or contact bounce. Without this feature, the alternate action selector keys might jitter on and/or off as each key was pressed or released. The scanning algorithm also looks for multiple key pressings and ignores any condition where two or more keys appear simultaneously pressed. This is required to eliminate "phantom key" detection caused by electrical shorting of the rows and columns of the matrix as certain combinations of keys are pressed. This key arrangement and scanning algorithm advantageously reduces the number of MCU input/output pins required to detect key pressings. Other key arrangements and scanning algorithms are also usable; however, the matrix approach is the most economical in terms of MCU resources. Any unused key positions in the matrix are reserved for future enhancements.

Also connected to the MCU are indicators in a 2-by-4 system status matrix 114A and a 2-by-6 motor status matrix 114B. The system status matrix 114A contains the power, heater and mode indicators, while the motor status matrix 114B contains the zone and special effect indicators. The system status matrix 114A is driven in a multiplexed fashion by MCU 110, each "column" of 4 LEDs being activated for about 49% of each display cycle. The period of the complete display cycle is short enough so that all activated indicators appear fully illuminated without any noticeable flicker. Flashing of selected indicators is a function performed by the control firmware independent of the display cycle.

The motor status matrix 114B has one column of LEDs for the zone modes (select, wave and pulse) and another for the special effect mode. The columns are driven mutually exclusively depending on the currently selected operating mode by logically combining idle motor drive signals with an enable signal from the MCU. LEDs within the selected column are activated by their associated motor drivers. The duty cycle is set to 16% so that variations in motor speeds generated by the PWM process, described below, do not cause variations in LED intensity.

The status indicator matrices 114A and 114B in combination with associated programming of the MCU advantageously reduces the number of MCU output pins required to illuminate the indicators. To further conserve MCU resources, the six drive signals of the system status matrix are shared with the key matrix 112. During the 2% of the display cycle when the display is inactive, five of the signals are used to scan the rows of the key matrix. The sixth signal is used as described below in a configuration selector 126 to identify particular components present in the system 10 upon power-on. Other visual indicator arrangements and driving algorithms are also possible; however, the matrix approach is the most economical in terms of MCU resources.

An array of motor drivers 118 are directly driven from individual MCU output ports. Massage intensity (motor speed) is controlled by pulse width modulation (PWM) of the signals applied to the drivers 118. This, in turn, controls the average power applied to the motor. While a duty cycle range of 0–100% is possible, other factors limit the range to about 16–98%. These factors include motor stalling at low speeds, and subjective evaluation of minimum and maximum intensity levels. To reduce the audible noise generated by the PWM process, the modulation frequency is set to approximately 70 Hz.

A heater driver circuit 120 includes heating pad drivers that are directly operated from individual MCU output ports. Heat level is controlled by pulse width modulation of the signal applied to the driver in the same manner as for the motor drivers. For high heat, the duty cycle is set to 100%. For low heat, the duty cycle is set to 100% for a warm up interval and then is reduced to 60%. The warm up interval ranges from 0 to 5 minutes depending on the amount of time the heater was previously off. The heating pads contain integral thermostats that limit the maximum operating temperature.

An audio detector 122, for connection to an external source of audio signals, is implemented as a fast-attack/slow-decay peak detector for sensing the amplitude envelope of the external source. Using a programmable analog comparator contained within the MCU 110, the firmware measures the envelope voltage at the output of the detector and scales the reading to a 0–100% value. The firmware then multiplies this value by the current intensity control value to generate an actual intensity control value used by the motors.

The massage system 10 is contemplated to be operated from a variety of electrical power sources, some of which can affect or impose restrictions on performance of the system. For example, one typical source is an AC line in combination with a low voltage transformer having limited available current and significant voltage drop as loads are applied, another contemplated source being an automobile electrical system. When the system is operated on DC being from an automobile storage battery, the current is not significantly limited and there is little or no voltage drop as loads are applied (such as by changing the number and duty cycle of the vibrators 12 being activated). Accordingly, the system 10 has a power source detector 124 that enables the MCU firmware to determine whether the system 10 is operating from an AC power source, to effect appropriate modification of driver activations by the MCU. The detector 124 is enabled and sensed once immediately following power-on. Under AC operation the available power is limited by the size of the transformer and the firmware must control the maximum power used by the motors, as described below with respect to the power control algorithm. Under DC operation, which is normally from an automobile storage battery, the system assumes that there is no limit to the power available; thus there is no constraint placed on the power to the motors. It will be understood that other combinations of power source limitations can exist, and appropriate detection of particular sources can be used to produce suitable modifications to driver activations.

A configuration selector 126 is also connected between the MCU and the key matrix 112 permit the firmware to determine the type of product in which the MCU is installed. This allows a variety of different systems to be configured, with each system containing unique combinations of the various features described herein. The selector 126 includes an array of 5 diodes that share the column data lines from the key matrix. The diodes are enabled and sensed once immediately following power-on. The information returned by the selector 126 specifies the physical key, visual indicator, motor and heater configuration in the actual product. The MCU firmware uses this information to modify the way in which it interacts with the user.

A power supply unit 128, including portions 128A and 128B feeds the various components of the system 10 from either an AC wall transformer or a DC battery supply. The operating voltage is nominally 12 V RMS AC or 12–14 V DC. The heaters 16 and 18 are driven directly from the power source using a non-polarized saturated transistor switching circuit. The power source is also fed to a full-wave bridge rectifier to create an unregulated 12 VDC (12–18 VDC from an AC supply). The unregulated DC supply is used to drive the motors and power a 5 V regulator for the MCU and logic circuitry.

Regarding the control programming of the MCU 110, the power control, speed control, default conditions, and a test mode of the present invention are more fully described below.

The power control: When operating from an AC transformer, the power available to drive the motors and heaters is limited by the maximum rating of the transformer. In addition, the rectified but unregulated DC voltage used to drive the motors varies according to the number of motor loads. With only one motor enabled, the DC voltage is closer to the AC peak value. As more motors are enabled, the DC voltage drops to near the AC RMS value. For AC operation, an appropriate transformer allows all motors to operate at full power without heaters and, with one or two heaters activated, allows reduced motor power, the transformer output power being preferably selected according to the number of heaters present in the system 10. The power control algorithm for AC operation is described in the following steps.

(a) At beginning of each PWM (pulse width modulation) period, the MCU 110 computes the maximum (100% intensity) duty cycle as a function of the number of motors enabled. The value is set to 48% plus 10% if a heater is enabled and 4% for each motor enabled. The incremental factors compensate for the DC voltage drop as loads are added.

(b) Next, an upper limit is selected. If no heaters are enabled, the limit is set to 99% minus 1% for each enabled motor. If a heater is enabled, the limited is set to 65% minus 1% for each enabled motor. The reduction factor compensates for added transformer loading.

(c) The maximum duty cycle is compared to the limit. If it is greater than the limit, it is reset to the limit value.

(d) The minimum PWM duty cycle, 16%, is subtracted from the maximum value and the result is multiplied by the intensity control value (0–100%). The minimum duty cycle is added back to the scaled result to obtain the actual duty cycle fort the current PWM period.

For DC operation, the heater and DC motor voltages are assumed to be essentially contact regardless of the load. The power control algorithm sets the maximum duty cycle to 99% and executes only Step (d) immediately above.

The speed control: The speed keys 98 adjust the step period for certain operating modes. Due to the manner in which speed changes are observed, the amount by which the step period is adjusted for each pressing of the SPEED key is a percentage of the current step period rather than a constant value. The percentage amount, P, is computed as the Nth root of R where R is the period range (maximum period minus minimum period) and N is the number of "SPEED" key steps allowed over R. Thus the step period change for each SPEED key pressing becomes $\pm S^*P/100$ where S is the current step period.

The default conditions: When power is applied to the unit, the operating states are set as follows:

(a) Massage and heater power are set off;

(b) Zone 1 is selected in manual mode;

(c) Intensity is set to 60%;

(d) Speed is set to one second per step; and (e) Fade and audio are disabled.

When the unit is turned on with massage power key 44, the previously selected zones, operating mode, intensity, speed, fade and audio states are retained. The massage timer, however, is reset to 15 minutes.

The test mode: The test mode is an automatic sequence of functions to test and/or demonstrate the capabilities of the unit. The procedure to evoke it and the functions it performs are as follows.

For evoking the test mode, the key entry sequence is (1) to press the POWER key, if necessary, until massage power is off (POWER visual indicator off) and (2) to press the INTENSITY UP key followed, within 1 second, by the SPEED DOWN key. At this point the POWER visual indicator rapidly flashes between red and green for 3 seconds. Pressing the POWER key during this interval starts the test mode. All other keys have their normal functions.

The test mode produces a sequence of functions, each test function executing for one or more test steps, a time period of each step being determined by the SPEED key. The SPEED and INTENSITY keys are active during test mode and may be used to alter the test speed and motor intensity, respectively. The test mode starts with all motors and visual indicators off and, while this sequence can be terminated at any time by pressing power key 44, it proceeds as follows:

(1) POWER visual indicator on green;

(2) POWER visual indicator on red;

(3) For one heater unit:

(a) LOW HEAT visual indicator and low heater on; and (b) LOW HEAT visual indicator off and HIGH HEAT visual indicator and high heat on; or (4) For two heater units;

(a) UPPER HEATER visual indicator and high heat on;

(b) UPPER HEATER visual indicator and heater off, LOWER HEATER visual indicator and high heat on; and (c) UPPER HEATER and LOWER HEATER visual indicators and high heat on;

(5) MANUAL visual indicator on;

(6) ZONE 1 visual indicator and motors on, followed in successive test steps by zones 2 through 5;

(7) MANUAL visual indicator off, all zone visual indicators and motors off, PULSE indicator on;

(8) Pulse function executed for two cycles (four steps) ending with all zone visual indicators and motors off;

(9) PULSE visual indicator off, WAVE visual indicator on and ZONE 1 visual indicator and motors on;

(10) Wave function executed for eight steps. WAVE visual indicator and all zone visual indicators and motors are turned off at the end of this sequence;

(11) Special effects 1 through 6 executed in succession for two cycles (four steps) each;

(12) Zone and special effects visual indicators and motors off;

(13) Heat visual indicators and heaters off; and

(14) All visual indicators off.

The test sequence ends with the massage and heater power off, and the unit may then be operated normally.

Firmware

Reference is now directed to FIGS. 5–12 which depict the flow charts or diagrams that describe the operation of the firmware of the present invention. The description and operation are divided into three sections, architecture, mainline modules and timer interrupt modules, in which "Y" and "N" respectively mean "yes" and "no" and "SE" means "special effects."

Architecture: The firmware is divided into a set of mainline and timer interrupt modules. The mainline modules have direct control of the massage portion of the device. They sense key pressings and change the massage operation as a function of the current operating mode. The timer interrupt modules perform all of the time dependent sense and control tasks requested by the mainline modules plus processing of power, heater, intensity and speed key pressings. The mainline and interrupt modules execute in an interlaced fashion with the latter preempting the former whenever a timer interrupt occurs. Communication between the two is via RAM flags and control words.

Figures 5, 6:
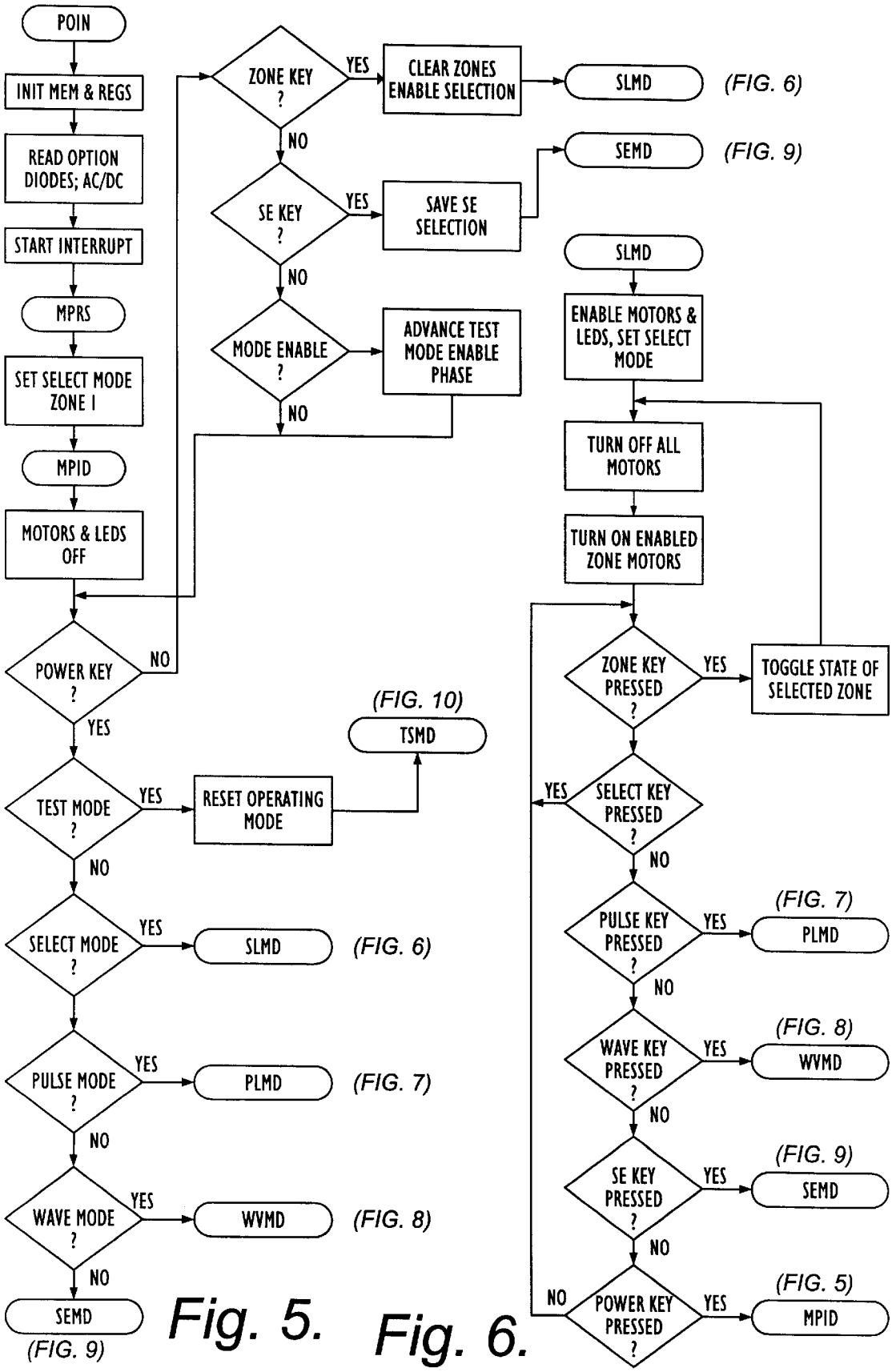

Mainline Modules: The names and functions of the mainline modules described in the flow charts in FIG. 5 are as follows:

Power-On Initialization (POIN) (FIG. 5). Executes once following application of the power key 44 to the device to initialize hardware registers, initialize RAM contents, read the option diodes, test for an AC or DC power supply and then start the timer interrupt module.

Massage Power Rests (MPRS) (also FIG. 5). Initializes the unit into Select Mode with Zone 1 enabled. Executed following POIN and TSMD (described below).

Massage Power Idle (MPID) (also FIG. 5). Executes when the massage power is off to sense key pressings that would turn the massage on. These include POWER (key 44), ZONE 1–5 (keys 50–58), SPECIAL EFFECTS (keys 82–92) and the two key sequences that enable the POWER key to turn the unit on in test mode.

Select Mode (SLMD) (FIG. 6). Executes when the unit is in Select Mode to run the selected zone motors and sense key pressings. The ZONE 1–5 keys toggle the state of the zones and the PULSE, WAVE and SPECIAL EFFECT keys (keys 74, 72, and 82–92, respectively) transfer execution to the appropriate module.

Figure 7:
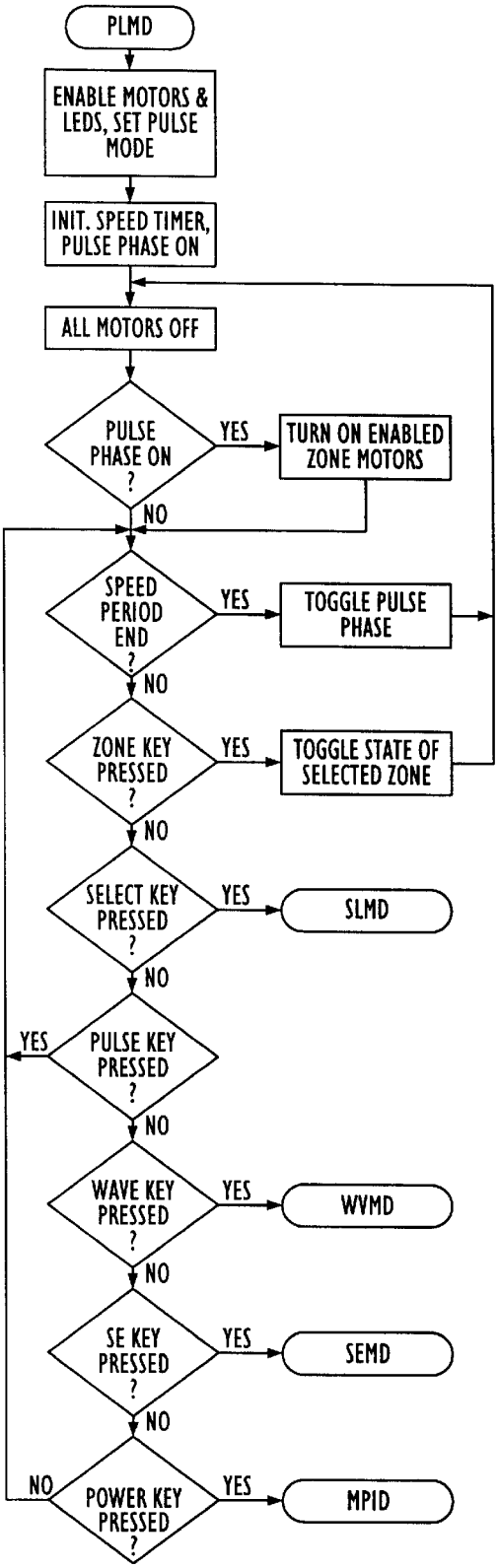

Pulse Mode (PLMD) (FIG. 7). Executes when the unit is in Pulse Mode to pulse the selected zone motors and sense key pressings. The ZONE 1–5 keys toggle the state of the zones and the SELECT, WAVE and SPECIAL EFFECT keys (keys 76, 72 and 82–92, respectively) transfer execution to the appropriate module.

Figure 8:
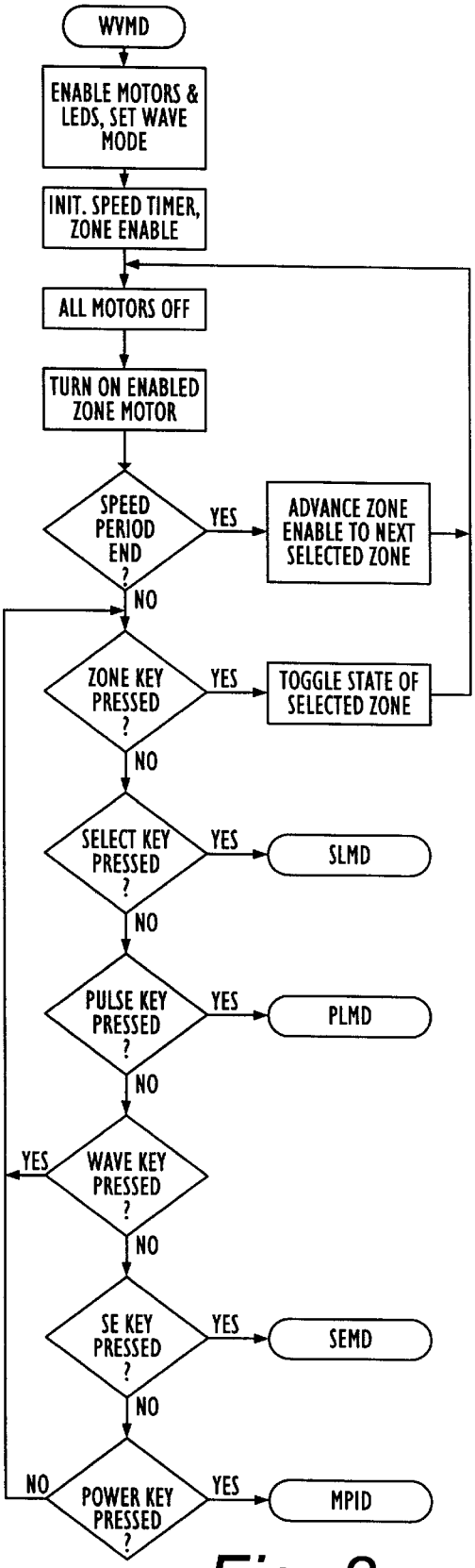

Wave Mode (WVMD) (FIG. 8). Executes when the unit is in Wave Mode to run the selected zone motors in wave fashion and sense key pressings. The ZONE 1–5 keys toggle the state of the zones and the SELECT, PULSE and SPECIAL EFFECT keys transfer execution to the appropriate module.

Figure 9:
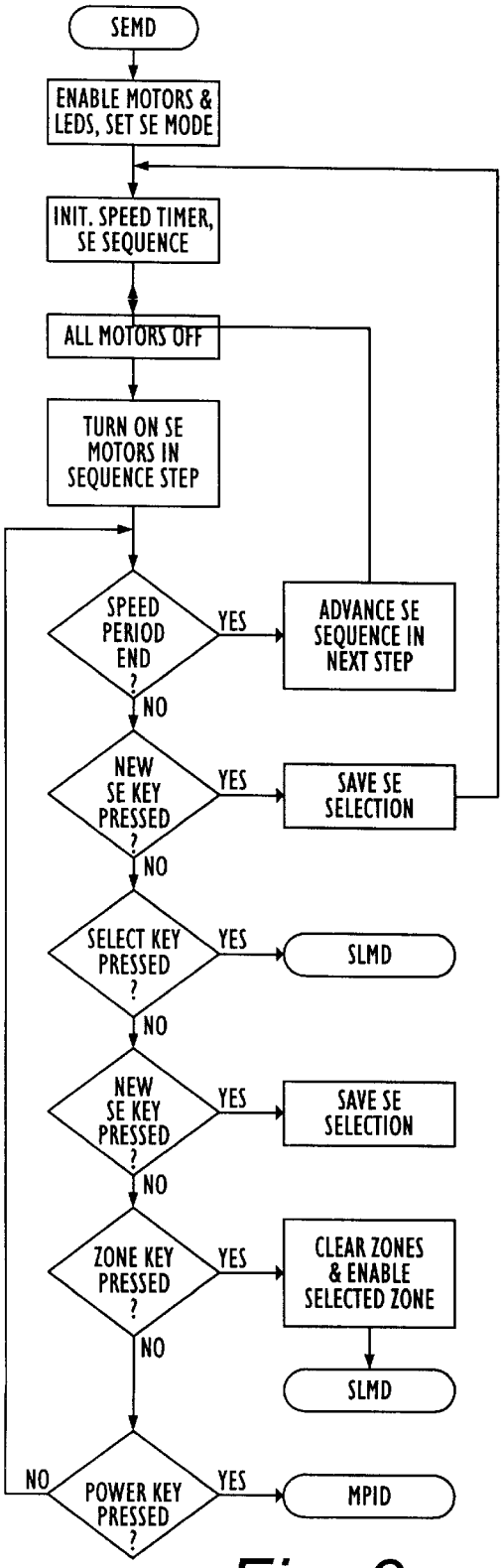

Special Effect Mode (SEMD) (FIG. 9). Executes when the unit is in Special Effect Mode to run the selected special effect sequence and sense key pressings. The SPECIAL EFFECT keys change the selected special effect. The ZONE 1–5 keys transfer to SLMD with the selected zone enabled, and the WAVE, PULSE and SELECT keys transfer to SVMD, PLMD and SLMD respectively with previously selected zones enabled.

Figure 10:
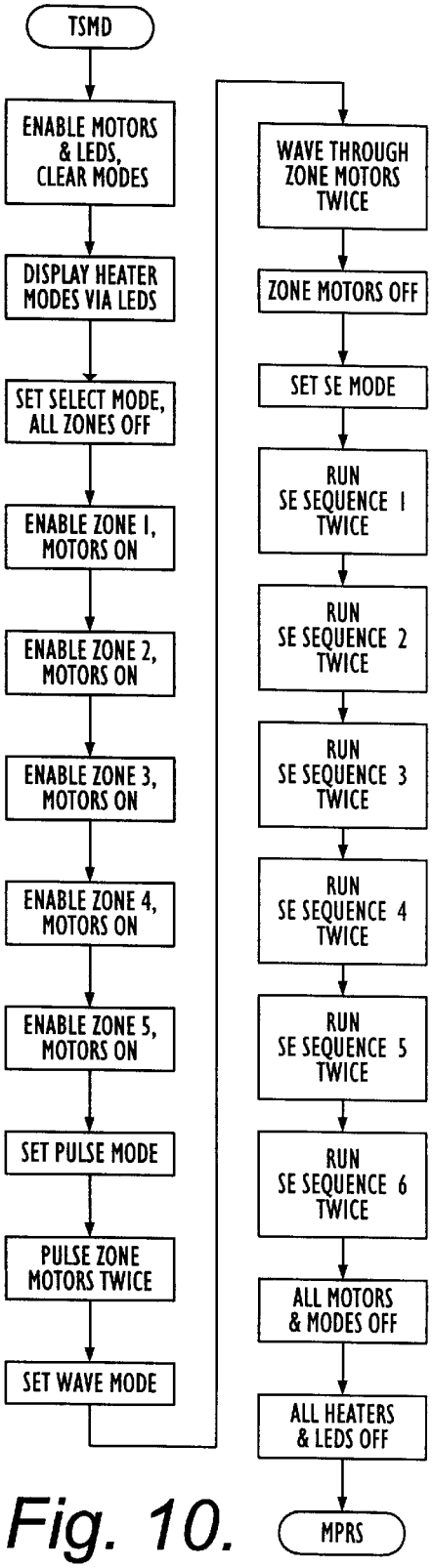

Test Mode (TSMD) (FIG. 10). Executes after the test mode enable key sequence is entered and POWER is pressed. The module tests the heaters, motors and LEDs by cycling through all combinations of the key enabled functions. When the test is complete, the massage and heaters are turned off and execution proceeds at MPRS.

Figure 11:
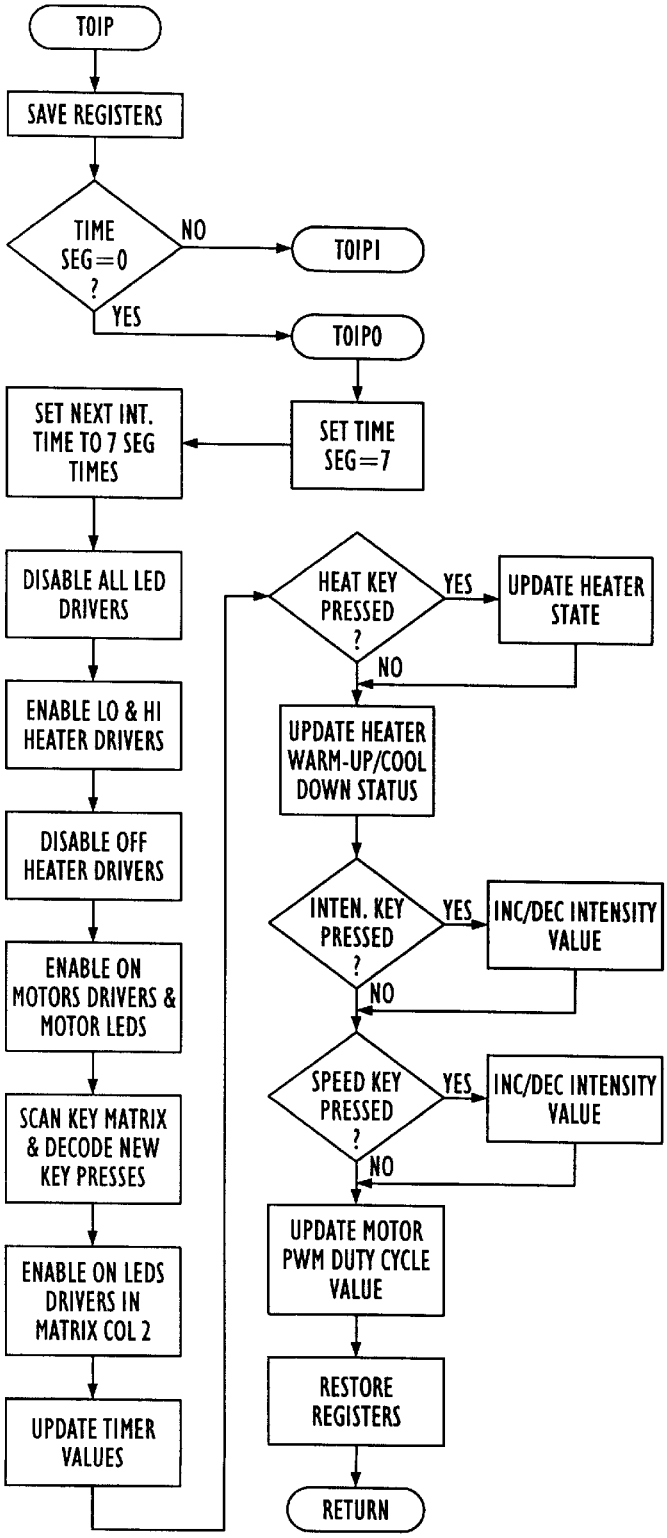

Timer Interrupt Modules: The timer interrupt modules define the 14,000 $\mu$s motor PWM (pulse width modulation) cycle. The PWM cycles is composed of 100 140 $\mu$s "time segments," each corresponding to a 1% duty cycle increment. Time segments are identified by a segment number stored in RAM. The first interrupt in the cycle is at the start of time segment 0. During this interrupt, once-per-cycle activities such as key matrix scanning and duty cycle recomputation are performed. The processor sets the next interrupt to occur 7 time segments later to allow additional time for processing. The next 93 interrupts occur at the beginning of times segments 7 through 99. The names and functions of the timer interrupt modules described in the flow charts are as follows:

1) Timer 0 Interrupt Processor (T0IP) (FIG. 11). Executes once upon the occurrence of each timer interrupt to save working registers and transfer to one of the other two modules as a function of the current time segment number.

2) Timer 0 Interrupt Processor 0 (T0IP0) (also FIG. 11). Executes during time segment 0 to process the once-per-cycle functions. Specific functions are as follows:

a) The timer is rest to interrupt at the start of segment 7 (980 $\mu$s later) and the time segment number is set to 7 for that interrupt.

b) All LED drivers are disabled.

c) The drivers for heaters on LOW or HIGH are enabled and the drivers for OFF heaters are disabled.

d) The drivers for ON motors are enabled.

e) The key matrix is scanned using a switch contract debouncing algorithm. Multiple key pressings are discarded and signal new key pressings are decoded and saved. If the POWER key was pressed, the current massage state and the power-on timer are updated.

f) The motor status LED driver for the selected operating mode is enabled. Only those LEDs associated with ON motors are illuminated.

g) The drivers for the ON LEDs in the system status LED matrix column 1 are enabled.

h) The massage power on timer, speed period timer, heater LED blink timer and heater warm-up/cool-down timer are updated.

i) If a heater key was pressed, the state for that heater is updated.

j) If an intensity key was pressed, the intensity value is incremented or decremented by 1.

k) If a speed key was pressed, the speed period value is incremented or decremented by 4% of its current value.

l) The motor PWM duty cycle is updated taking into account the number of motors running, the motor intensity level, the current heater status and the type of power supply. The new value is used in the current PWM cycle.

m) The working registers are restored, and control is returned to the interrupted mainline module.

Figure 12:
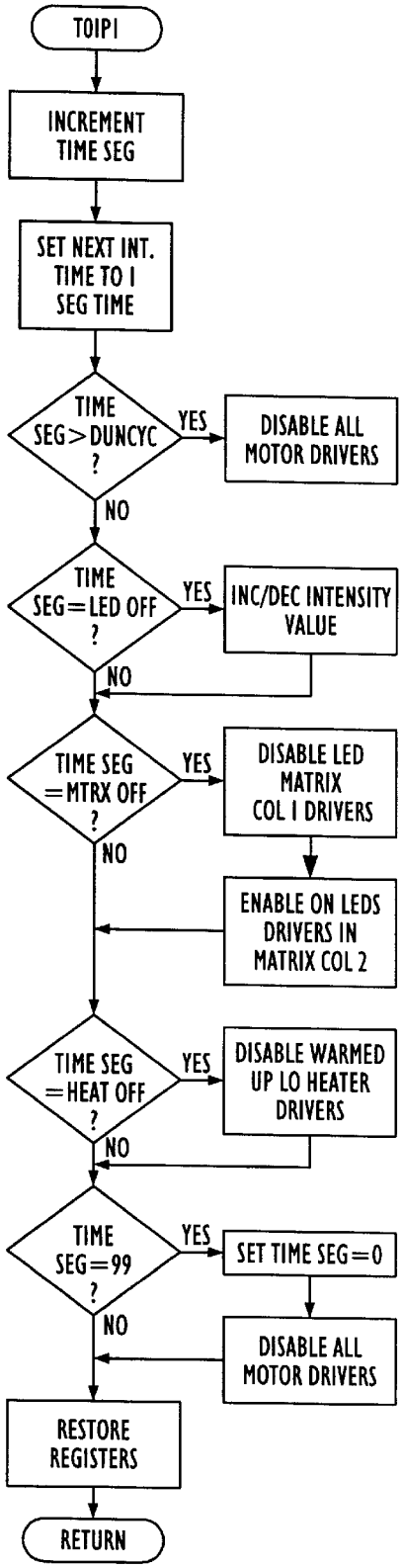

3) Timer 0 Interrupt Processor 1 (T0IP1) (FIG. 12). Executes during time segments 7 through 99 to process time segment dependent functions as follows:

a) The timer is reset to interrupt at the start of the next time segment (140 $\mu$s later) and the segment number is incremented by one for that interrupt.

b) If the current segment number is greater than or equal to the motor PWM duty cycle, the motor drivers are disabled.

c) If the current segment number is one of the following, the described function is performed.

i) For segment 16, the motor status LED driver is disabled;

ii) For segment 51, the drivers for system status LED matrix column 1 are disabled and those for the ON LEDs in column 2 are enabled;

iii) For segment 60, the drivers for heaters on LOW that have passed their warm-up time are disabled; and iv) For segment 99, the segment number is set to 0 and all motor drivers are disabled.

d) The working registers are restored and control is returned to the interrupted mainline module.

Although the present invention has been described in considerable detail with reference to certain preferred versions thereof, other versions are possible. For example, the system 10 can utilize separately settable intensity control values for each of the vibrators 12. Also, the test mode can be modified so that either the whole test or selected portions thereof are performed, either once or repeatably, in response to operator input. Therefore, the spirit and scope of the appended claims should not necessarily be limited to the description of the preferred versions contained herein.

What is claimed is:

1. A method for massaging a user contacting a pad, using electrical power from a source having a voltage drop as loads are added, the method comprising the steps of:

(a) providing a plurality of eccentric motor vibrators in respective regions of the pad;

(b) providing a microprocessor controller, an array of input elements for interrogation by the controller, and a plurality of drivers for powering the vibrators from the power source in response to the controller;

(c) interrogating the input elements by the controller to determine an intensity control value and vibrators to be activated;

(d) determining a maximum duty cycle being a base duty cycle plus a load increment duty cycle for each of the vibrators to be activated; and (e) periodically activating the drivers for producing respective operating duty cycles of activated motors being responsive to the intensity control value and limited to the maximum duty cycle.

2. The method of claim 1, comprising the further steps of:

(a) providing a heater element in the pad;

(b) providing a heater driver for powering the heater element in response to the controller;

(c) the interrogating step includes determining a heat control input; and (d) the step of determining the maximum duty cycle comprises:

(i) adding a heater increment duty cycle when the heater element is activated;

(ii) determining a duty cycle upper limit being a base limit less a portion of the load increment for each of the motors being simultaneously activated and, if the heater element is activated, the upper limit being further reduced by a heater reduction duty cycle; and (iii) limiting the maximum duty cycle of each motor power signal to not more than the duty cycle upper limit.

3. A computer controlled massaging system comprising:

(a) a pad for contacting a user of the system;

(b) a plurality of vibratory transducers for vibrating respective regions of the pad, each transducer including a motor having a mass element eccentrically coupled thereto, the motor being responsive to a motor power signal;

(c) a microprocessor controller having program and variable memory and an input and output interface;

(d) an array of input elements connected to the input interface for signaling the microprocessor in response to operator input, the signaling including an intensity control value and at least one region signal relating motors to be activated; and (e) a plurality of motor drivers responsive to the output interface for producing, separately for each of the motors, the power signal; and (f) means for powering the microprocessor and the drivers from a first source of electrical power, the first source having a voltage drop as loads are added, wherein each motor power signal has a maximum duty cycle being a base duty cycle plus a load increment duty cycle for each of the motors being simultaneously activated, the microprocessor controller periodically activating the drivers for producing, in response to the intensity control value, respective operating duty cycles for the activated motors being limited to the maximum duty cycle.

4. The massaging system of claim 1, further comprising a heater element in the pad, a heater driver responsive to the microprocessor controller for activating the heater element, wherein the signaling further includes a heat control input, and wherein the maximum duty cycle of each motor power signal is augmented by a heater increment duty cycle when the heater element is activated.

5. The massaging system of claim 4, having a duty cycle upper limit being a base limit less a portion of the load increment for each of the motors being simultaneously activated and, if the heater element is activated, the upper limit being further reduced by a heater reduction duty cycle, the maximum duty cycle of each motor power signal being limited to not more than the duty cycle upper limit.

6. The massaging system of claim 5, wherein each motor power signal has a minimum duty cycle, the operational duty cycle being scaled from the product of the intensity control value and the maximum duty cycle less the minimum duty cycle, the minimum duty cycle being added to the product.

7. The massaging system of claim 4, wherein the heat control input has off, high, and low states for selectively powering the heater at high power, low power, and no power, and wherein the microprocessor controller is operative for activating the heater driver to power the heater element at high power when the heat control input is high, at no power when the heat control input is off, and at low power when the heat control input is low, except that when the heat control input is changed from off to low, the microprocessor controller is operative for powering the heater at high power for a warm up interval of time prior to the low power, the warm up interval being dependent on a time interval of the off state of the control input.

8. The massaging system of claim 3, for use additionally with a second power source, the second power source not having a voltage drop as great as the voltage drop of the first source as loads are added, the system further comprising a power detector for sensing whether the second power source is being used, the microprocessor being programmed for increasing the base duty cycle and reducing the load increment duty cycle during operation from the second power source.

9. The massaging system of claim 3, further comprising a configuration selector for determining and signaling to the microprocessor controller particular components being electrically connected in the system for utilizing a single set of programmed instructions in the program memory in variously configured examples of the massaging system.

10. A computer controlled massaging system comprising:

(a) a pad for contacting a user of the system;

(b) a plurality of vibratory transducers for vibrating respective regions of the pad, each transducer including a motor having a mass element eccentrically coupled thereto, the motor being responsive to a motor power signal;

(c) a microprocessor controller having program and variable memory and an input and output interface;

(d) an array of input elements connected to the input interface for signaling the microprocessor in response to operator input, the signaling including an intensity control value and at least one region signal relating motors to be activated; and (e) a plurality of motor drivers responsive to the output interface for producing, separately for each of the motors, the power signal; and (f) a configuration selector for determining and signaling to the microprocessor controller particular components being electrically connected in the system for utilizing a single set of programmed instructions in the program memory in variously configured examples of the massaging system.

11. The massage system of claim 10, wherein the input elements are connected in a matrix for scanning by the microprocessor controller, and the configuration selector comprises a plurality of diodes connected between respective portions of the matrix and the microprocessor controller.

12. A computer controlled massaging system comprising:

(a) a pad for contacting a user of the system;

(b) a vibratory transducer for vibrating the pad, the transducer including a motor having a mass element eccentrically coupled thereto, the motor being responsive to a motor power signal;

(c) a heater element in the pad;

(d) a microprocessor controller having program and variable memory and an input and output interface;

(e) an array of input elements connected to the input interface for signaling the microprocessor in response to operator input, the signaling including an intensity control value for the motor and a heat control input having off, high, and low states corresponding to high power, low power, and no power of the heater element;

(f) a motor driver and a heater driver responsive to the output interface for producing the power signal for the motor, and for powering the heater; and (g) wherein the microprocessor controller is operative for activating the heater driver to power the heater at high power when the heat control input is high, at no power when the heat control input is off, and at low power when the heat control input is low, except that when the heat control input is changed from off to low, the microprocessor controller is operative for powering the heater at high power for a warm up interval of time prior to the low power, the period of time being dependent on a time interval of the off state of the control input.

13. A computer controlled massaging system comprising:

(a) a pad for contacting a user of the system;

(b) a plurality of vibratory transducers for vibrating respective regions of the pad, each transducer including a motor having a mass element eccentrically coupled thereto, the motor being responsive to a motor power signal;

(c) a heater element in the pad;

(d) a microprocessor controller having program and variable memory and an input and output interface;

(e) an array of input elements connected to the input interface for signaling the microprocessor in response to operator input, the signaling including an intensity control value, at least one region signal relating motors to be activated, at least one mode signal, and a heat control input;

(f) a plurality of motor drivers responsive to the output interface for producing, separately for each of the motors, the power signal;

(g) a heater driver responsive to the output interface for powering the heater; and (h) the microprocessor controller being operative in response to the input elements for activating the motors and the heater element for operation thereof in correspondence with the input elements, and in a test mode wherein each of the motors and the heater is activated sequentially in accordance with substantially every state of the region signal, mode signal, and the heat control input, the motors being activated at power levels responsive to intensity control value.

14. The massaging system of claim 13, wherein the signaling further includes a speed input for determining a rate of sequencing mode component intervals, and wherein, during the test mode, the sequential activation is at a rate proportional to the speed input.

15. The system of claim 14, wherein the signaling further includes a power input for selectively invoking massage power on and off states of the system, and the test mode is enabled by activation of one of the intensity and speed inputs, followed within one second by activation of the other of the intensity and speed inputs, when the system is in the power off state.

16. The system of claim 15, wherein the intensity and speed inputs each include positive and negative components for respectively incrementing and decrementing respective control values, and wherein enabling of the test mode requires activation of one of the positive and negative components of the intensity input and activation of the other of the positive and negative components of the speed input.

17. The system of claim 15, wherein the test mode is entered upon activation of the power input within a predetermined period of time subsequent to the test mode being enabled.

18. The system of claim 13, wherein the at least one region signal is one of at least four region signals, the at least one mode signal is one of at least four mode signals, the sequential activation of the test mode is in accordance with substantially all of the region and mode signals.

19. The system of claim 18, wherein at least some of the signals define more than two operational states of the system, and the sequential activation of the test mode is further in accordance with substantially every operational state of the system.

20. The system of claim 13, further comprising a configuration selector for determining and signaling to the microprocessor particular components being electrically connected in the system for utilizing a single set of programmed instructions in the program memory in variously configured examples of the massaging system, wherein the test mode is implemented for skipping states corresponding to components not connected in the system.

21. A computer controlled massaging system comprising:

(a) a pad for contacting a user of the system;

(b) a plurality of vibratory transducers for vibrating respective regions of the pad, each transducer including a motor having a mass element eccentrically coupled thereto, the motor being responsive to a power signal;

(c) a heater element in the pad;

(d) a microprocessor controller having program and variable memory and an input and output interface;

(e) an array of input elements connected to the input interface for signaling the microprocessor in response to operator input, the signaling including an intensity control value, at least one region signal relating motors to be activated, and a heat control input; and (f) a plurality of motor drivers responsive to the output interface for producing, separately for each of the motors, the power signal;

(g) a heater driver responsive to the controller for activating the heater element;

(h) means for powering the microprocessor and the drivers from a first source of electrical power having a voltage drop as loads are added, and a second source not having a voltage drop as great as the voltage drop of the first power source;

(i) a power detector for sensing whether the second power source is being used, the microprocessor controller being programmed for increasing the base duty cycle and reducing the load increment duty cycle during operation from the second power source; and (j) a configuration selector for determining and signaling to the microprocessor particular components being electrically connected in the system for utilizing a single set of programmed instructions in the program memory in variously configured examples of the massaging system, wherein:

(i) each power signal has a maximum duty cycle being a base duty cycle plus a load increment duty cycle for each of the motors being simultaneously activated, and augmented by a heater increment duty cycle when the heater element is activated;

(ii) each power signal also has a duty cycle upper limit being a base limit less a portion of the load increment for each of the motors being activated, the upper limit being further reduced by a heater reduction duty cycle; and (iii) the power signal maximum duty cycle is limited to not more than the duty cycle upper limit, the microprocessor controller periodically activating the drivers for producing, in response to the intensity control value, respective operating duty cycles for the activated motors being limited to the maximum duty cycle.

* * * * *